US011638089B2

(12) United States Patent
Wang et al.

(10) Patent No.: US 11,638,089 B2
(45) Date of Patent: Apr. 25, 2023

(54) SPEAKER MODULE AND WEARABLE DEVICE

(71) Applicant: HTC Corporation, Taoyuan (TW)

(72) Inventors: Yen-Chieh Wang, Taoyuan (TW); Sung Jen Wang, Taoyuan (TW); Yu-Zhen He, Taoyuan (TW)

(73) Assignee: HTC Corporation, Taoyuan (TW)

( * ) Notice: Subject to any disclaimer, the term of this patent is extended or adjusted under 35 U.S.C. 154(b) by 0 days.

(21) Appl. No.: 17/539,201

(22) Filed: Dec. 1, 2021

(65) Prior Publication Data

US 2022/0174403 A1 Jun. 2, 2022

Related U.S. Application Data

(60) Provisional application No. 63/119,665, filed on Dec. 1, 2020.

(51) Int. Cl.

| | |
|---|---|
| ***H04R 1/34*** | (2006.01) |
| ***H04R 1/28*** | (2006.01) |
| ***H04R 5/02*** | (2006.01) |
| ***H04R 5/04*** | (2006.01) |

(52) U.S. Cl.

CPC ..... *H04R 1/345* (2013.01); *H04R 1/2803* (2013.01); *H04R 5/02* (2013.01); *H04R 5/04* (2013.01); *H04R 2499/15* (2013.01)

(58) Field of Classification Search

CPC ..... H04R 1/345; H04R 1/2803; H04R 5/02; H04R 5/04; H04R 2499/15

See application file for complete search history.

(56) References Cited

U.S. PATENT DOCUMENTS

| | | | |
|---|---|---|---|
| 7,433,483 | B2 | 10/2008 | Fincham |
| 7,953,461 | B2 | 5/2011 | Fukazawa |
| 9,105,261 | B2 | 8/2015 | Horii |
| 10,025,119 | B2 | 7/2018 | Huynh |
| 10,555,071 | B2 | 2/2020 | Wakeland et al. |
| 10,728,651 | B2 | 7/2020 | Rusconi Clerici Beltrami et al. |
| 10,812,896 | B2 | 10/2020 | Oishi et al. |
| 2018/0167711 | A1* | 6/2018 | Lin ..... H04R 1/1016 |

FOREIGN PATENT DOCUMENTS

| | | |
|---|---|---|
| WO | 2019145023 | 8/2019 |

OTHER PUBLICATIONS

"Office Action of Europe Counterpart Application", dated May 13, 2022, p. 1-p. 4.

"Search Report of Europe Counterpart Application", dated Mar. 3, 2022, p. 1-p. 4.

* cited by examiner

*Primary Examiner* — Andrew L Sniezek

(74) *Attorney, Agent, or Firm* — JCIPRNET

(57) ABSTRACT

A speaker module adapted to be disposed on a wearable device. The speaker module includes at least one driving unit and an enclosure. The driving unit is configured to produce sound. The enclosure contains the driving unit and has a front chamber and a rear chamber. The front chamber and the rear chamber are individually located at two opposite sides of the driving unit. The enclosure has a front opening, a first rear opening, and a second rear opening. The front opening communicates with the front chamber. The first rear opening and the second rear opening individually communicate with the rear chamber. A sum of sound outputted from the front opening, the first rear opening, and the second rear opening has directivity.

18 Claims, 23 Drawing Sheets

SPEAKER MODULE AND WEARABLE DEVICE

CROSS-REFERENCE TO RELATED APPLICATION

This application claims the priority benefit of U.S. provisional application Ser. No. 63/119,665, filed on Dec. 1, 2020. The entirety of the above-mentioned patent application is hereby incorporated by reference herein and made a part of this specification.

BACKGROUND

Technical Field

The disclosure relates to a speaker module, and in particular, relates to a speaker module adapted to be disposed on a wearable device.

Description of Related Art

At present, headphones or micro-speakers are used most of the time by a user to listen to sound produced by a wearable device. Due to factors such as personal preferences and differences in body structures, the positions for wearing wearable devices are different. However, it is difficult for the speakers currently available on the market to adapt to these variations of wearing. Whether it is in-ear headphones or over-ear headphones, when being worn, the headphones may produce an insecure feeling of isolation from the outside. Further, the headphones may cause discomfort after being worn for a long period of time because the headphones are attached to the ears. Further, when the sound-emitting components of the headphones are attached to the left and right ears, in order to allow a 3D surround effect to be provided, many spatial sound effects are required to be simulated. However, every time the sound reaches the ears, the user often cannot distinguish the source of the sound due to the lack of directivity in the transmission of the sound. Besides, non-personalized spatial sound effects may lead to poor effects, or factors such as different wearing positions each time may lead to unstable effects of wearing of the headphones.

In addition, at present, in order to facilitate device integration, small driving components are adopted for the mainstream micro-speakers currently available on the market, as such, it is difficult for these micro-speakers to provide comprehensive and realistic sound bandwidth, volume, and directivity. The mainstream head mount displays (HMDs) are equipped with a pair of speakers or multiple speakers, and most of them are designed to be conventional closed-type speakers and feature no directivity function. As such, the sense of reality is reduced, the privacy provided by closed headphones is absent, and the left and right channels obviously interfere with each other.

SUMMARY

The disclosure provides a speaker module in which a sum of sound outputted by the speaker module has directivity.

The disclosure further provides a wearable device including a speaker module in which a sum of sound outputted by the speaker module has directivity.

A speaker module provided by the disclosure is adapted to be disposed on a wearable device, and the speaker module includes at least one driving unit and an enclosure. The driving unit is configured to produce sound. The enclosure contains the driving unit and has a front chamber and a rear chamber, and the front chamber and the rear chamber are individually located at two opposite sides of the driving unit. The enclosure has a front opening, a first rear opening, and a second rear opening. The front opening communicates with the front chamber. The first rear opening and the second rear opening individually communicate with the rear chamber. A sum of sound outputted from the front opening, the first rear opening, and the second rear opening has directivity.

A wearable device provided by the disclosure includes a frame and at least one speaker module. The speaker module includes at least one driving unit and an enclosure. The driving unit is configured to produce sound. The enclosure contains the driving unit and has a front chamber and a rear chamber, and the front chamber and the rear chamber are individually located at two opposite sides of the driving unit. The enclosure has a front opening, a first rear opening, and a second rear opening. The front opening communicates with the front chamber. The first rear opening and the second rear opening individually communicate with the rear chamber. A sum of sound outputted from the front opening, the first rear opening, and the second rear opening has directivity.

A speaker module provided by the disclosure is adapted to be disposed on a wearable device. The speaker module includes at least two driving units and an enclosure. The two driving units are configured to produce sound. The enclosure contains the two driving units and has a front chamber and a rear chamber, and the front chamber and the rear chamber are individually located at two opposite sides of the two driving units. The enclosure has a front opening, a first rear opening, and a second rear opening. The front opening communicates with the front chamber. The first rear opening and the second rear opening individually communicate with the rear chamber. A sum of sound outputted from the front opening, the first rear opening, and the second rear opening has directivity. The enclosure further includes a front cover, a rear cover, and a partitioning plate. The partitioning plate is located between the front cover and the rear cover, and the partitioning plate and the front cover form the front chamber. The partitioning plate and the rear cover form the rear chamber. The partitioning plate has two slot holes. The two driving units are separately arranged in the two slot holes.

To sum up, in the disclosure, the sum of sound outputted by the speaker module has directivity, so that the deviation caused by the user's wearing variations and the differences in the structures of the human bodies may be reduced. In addition, the directivity may further isolate voices, making it difficult to hear the voice content outputted by the speaker module from the outside. A private using scenario is therefore created, and the user is allowed to enjoy a realistic listening experience as well as a comfortable using experience.

DESCRIPTION OF THE EMBODIMENTS

Figure 1A:
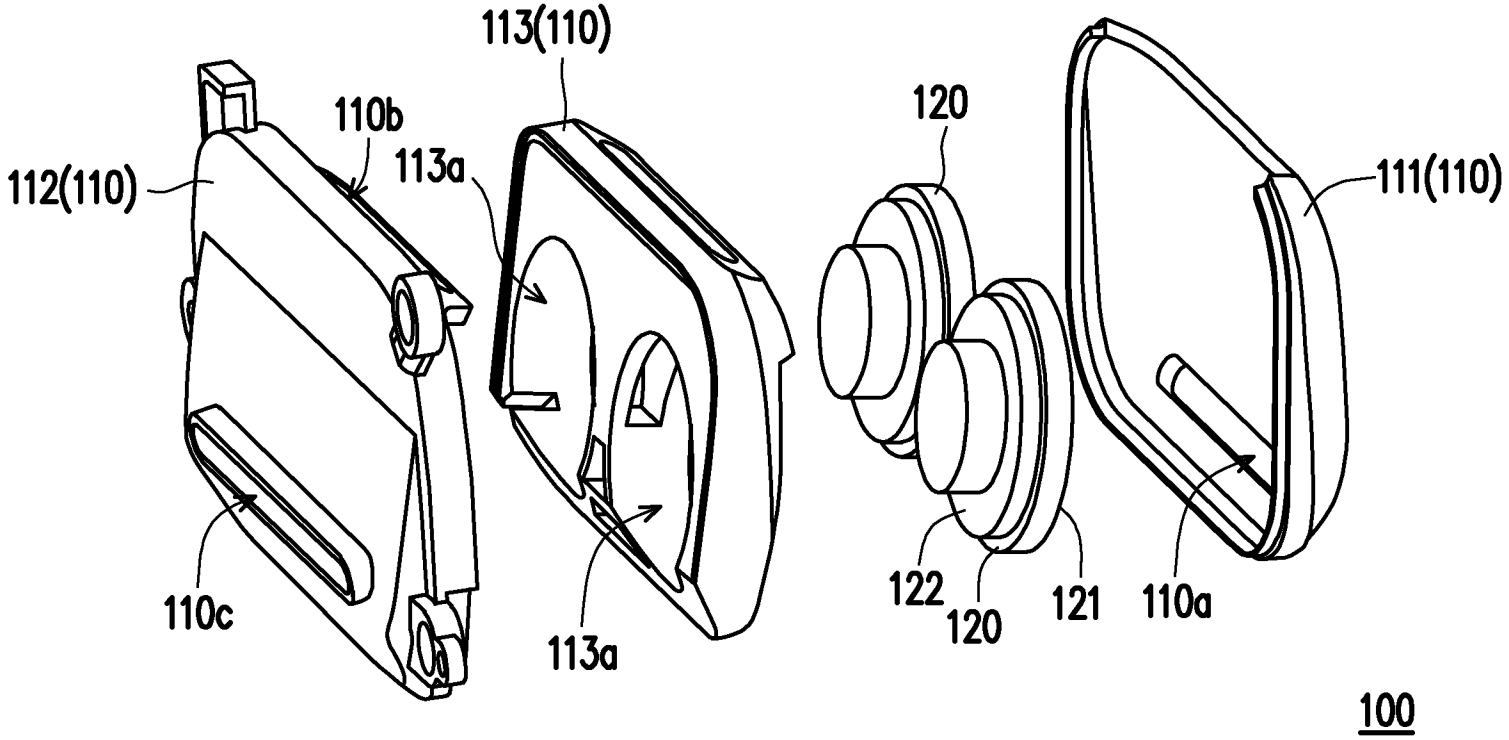
FIG. 1A is an exploded view of a speaker module according to an embodiment of the disclosure.
Figure 1B:
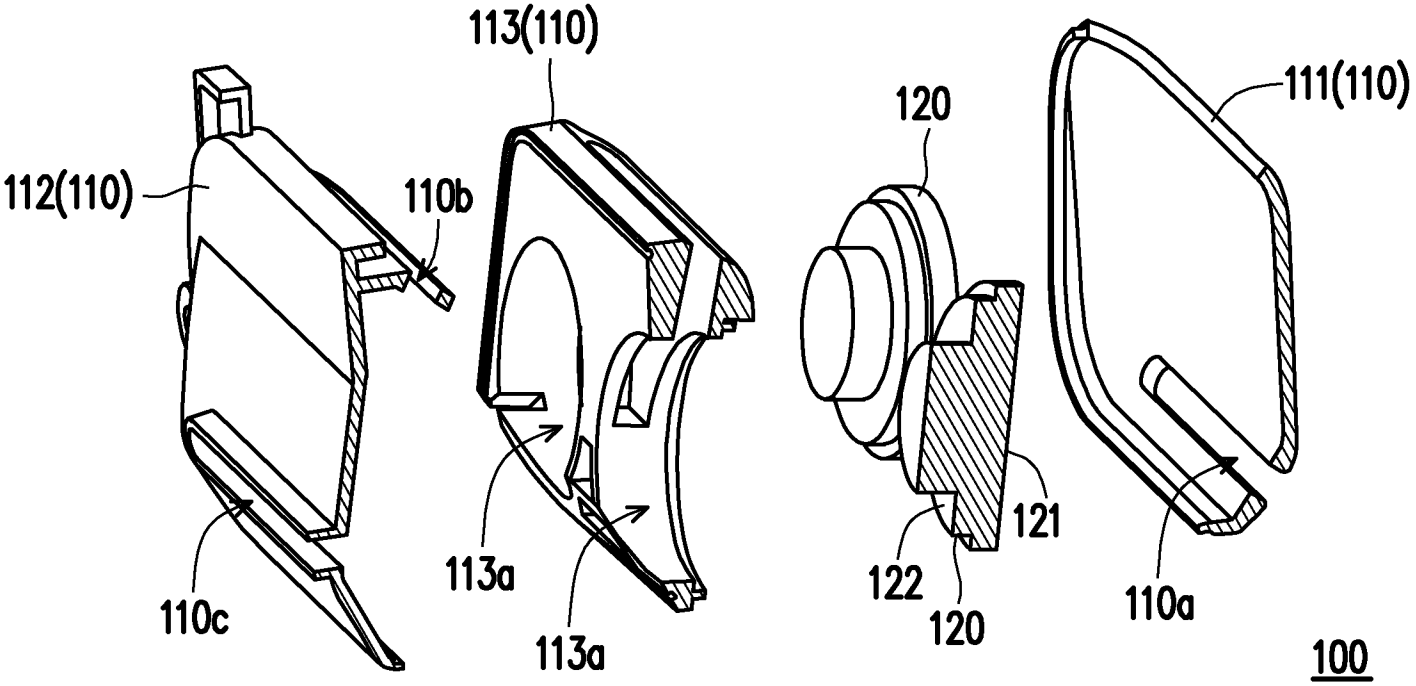
FIG. 1B is a cross-sectional view of the speaker module of FIG. 1A.

With reference to FIG. 1A and FIG. 1B, in this embodiment, a speaker module 100 has an enclosure 110 and at least one driving unit 120. The at least one driving unit 120 is arranged in the enclosure 110. The enclosure 110 has a front cover 111, a rear cover 112, and a partitioning plate 113 arranged between the front cover 111 and the rear cover 112. The partitioning plate 113 has at least one slot hole 113*a*. The partitioning plate 113 and the front cover 111 form a front chamber 114. The partitioning plate 113 and the rear cover 112 form a rear chamber 115. In this embodiment, a number of the at least one driving unit 120 and a number of the at least one slot hole 113*a* are both two. In other embodiments, the number of the driving units and the number of the slot holes may also be one or may be greater than three, as long as the number of the slot holes and the number of the driving units are the same, which is not particularly limited.

As described above, the enclosure 110 further includes a front opening 110*a*, a first rear opening 110*b*, and a second rear opening 110*c*. The front opening 110*a* communicates with the front chamber 114, and the first rear opening 110*b* and the second rear opening 110*c* individually communicate with the rear chamber 115. Each of the driving units 120 has a front surface 121 and a rear surface 122 opposite to each other. The front surface 121 faces the front cover 111. The rear surface 122 faces the rear cover 112. A sound wave transmitted from the front surface 121 is outputted from the front opening 110*a*. A sound wave transmitted from the rear surface 122 is outputted from the first rear opening 110*b* and the second rear opening 110*c*. That is, the driving units 120 are arranged between the front chamber 114 and the rear chamber 115, and the front chamber 114 does not communicate with the rear chamber 115.

Figure 2:
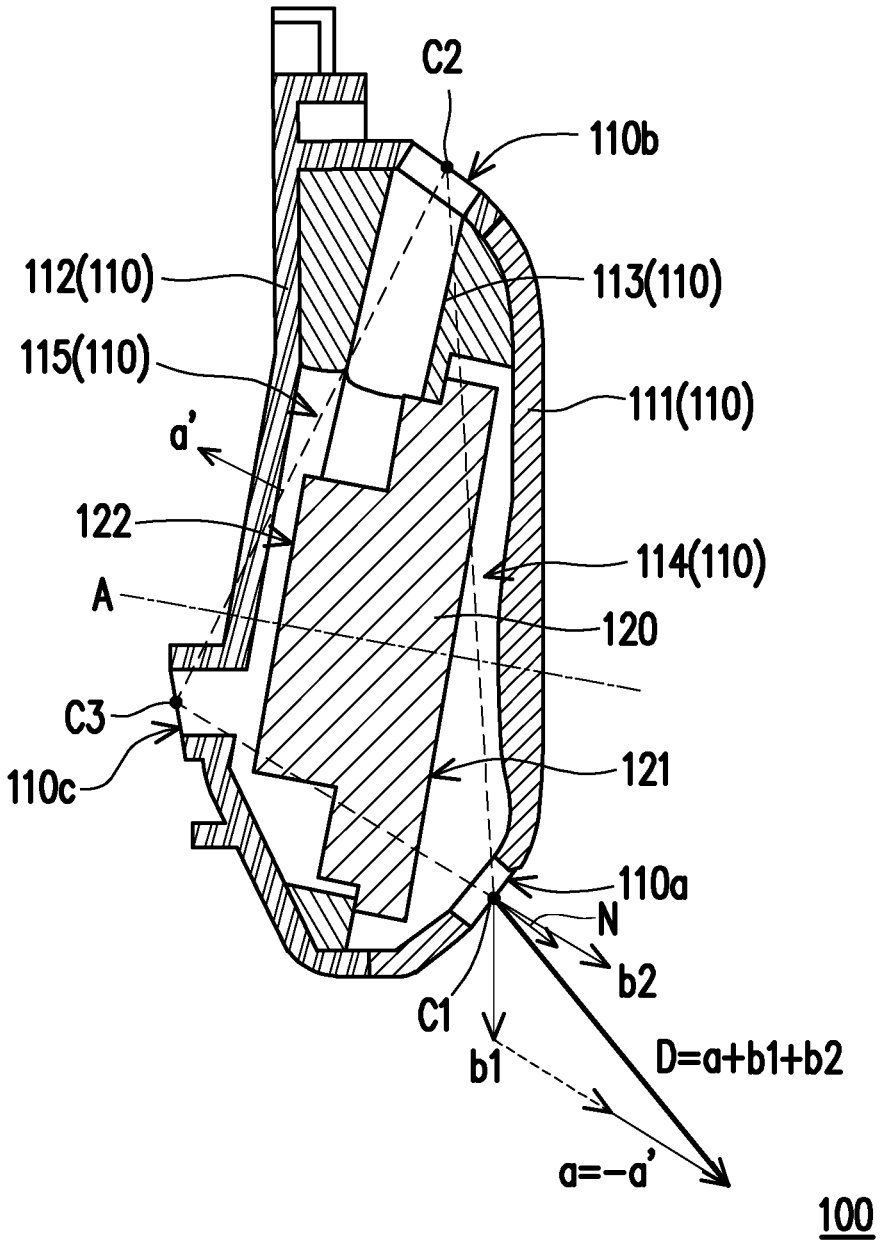
FIG. 2 is a cross-sectional view of the speaker module of FIG. 1A after being assembled.

With reference to FIG. 2, a direction D of a sum of sound of the speaker module 100 is formed by vectors formed by the front opening 110*a*, the first rear opening 110*b*, and the second rear opening 110*c*. To be specific, a connecting line between the front opening 110*a* and the first rear opening 110*b* forms a first vector b1 directed to the front opening 110*a*. A connecting line between the front opening 110*a* and the second rear opening 110*c* forms a second vector b2 directed to the front opening 110*a*. A connecting line between the first rear opening 110*b* and the second rear opening 110*c* forms a third vector directed to the second rear opening 110*c*, where the third vector has a normal vector a' away from the driving units 120. The normal vector a' has a reverse vector a directed to the driving units 120. The first vector b1, the second vector b2, and the reverse vector a are added to form the direction D of the sum of sound. When sizes of the front opening 110*a*, the first rear opening 110*b*, and the second rear opening 110*c* are the same, the direction D of the sum of sound is D=a+b1+b2. When the sizes of the front opening 110*a*, the first rear opening 110*b*, and the second rear opening 110*c* are different, appropriate weighting is performed, and the direction D of the sum of sound herein is D=w1a+w2b1+w3b2, where w1, w2, and w3 are weighting coefficients.

For instance, the vectors may also be formed by centroids of the openings. A plane surrounded by the front opening 110*a* has a first centroid C1. A plane surrounded by the first rear opening 110*b* has a second centroid C2. A plane surrounded by the second rear opening 110*c* has a third centroid C3. The first centroid C1 and the second centroid C2 form the first vector b1 in a direction towards the first centroid C1. The first centroid C1 and the third centroid C3 form the second vector b2 in a direction towards the first centroid C1. The second centroid C2 and the third centroid C3 form the third vector in a direction towards the third centroid C3. The third vector has the normal vector a' away from the first centroid C1. The normal vector a' has the reverse vector a directed to the first centroid C1. The first vector b1, the second vector b2, and the reverse vector a are unit vectors. The first vector b1, the second vector b2, and the reverse vector a are added to form the direction D of the sum of sound.

Figure 12B:
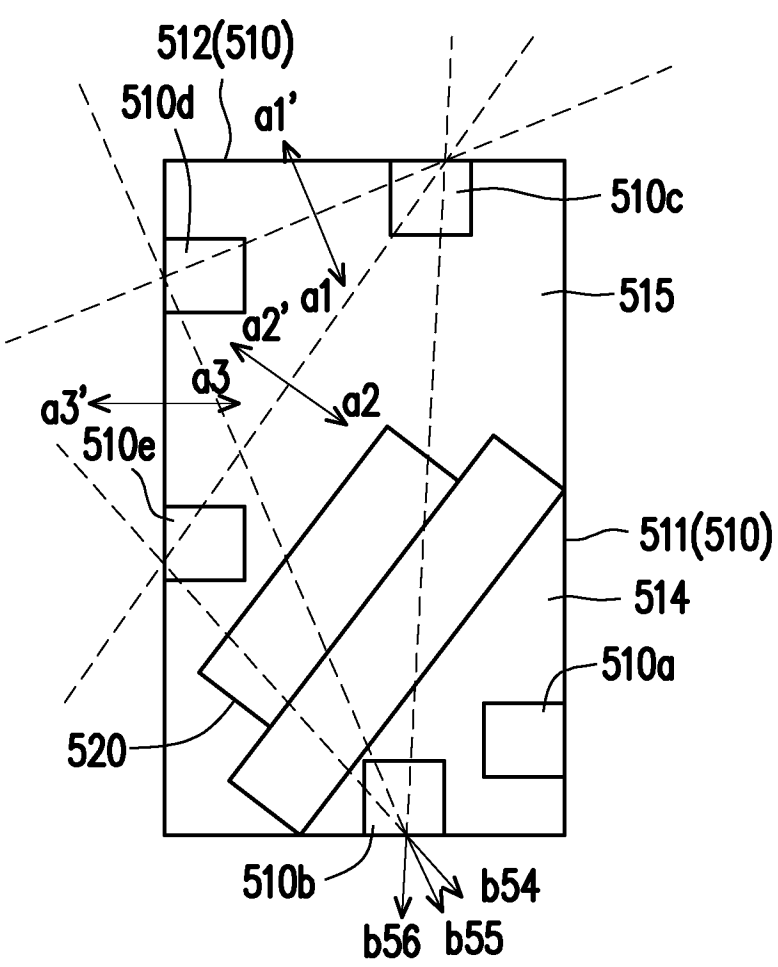
FIG. 12A to FIG. 12C are schematic diagrams of a speaker module and a direction of a sum of sound thereof according to another embodiment of the disclosure.
Figure 12A:
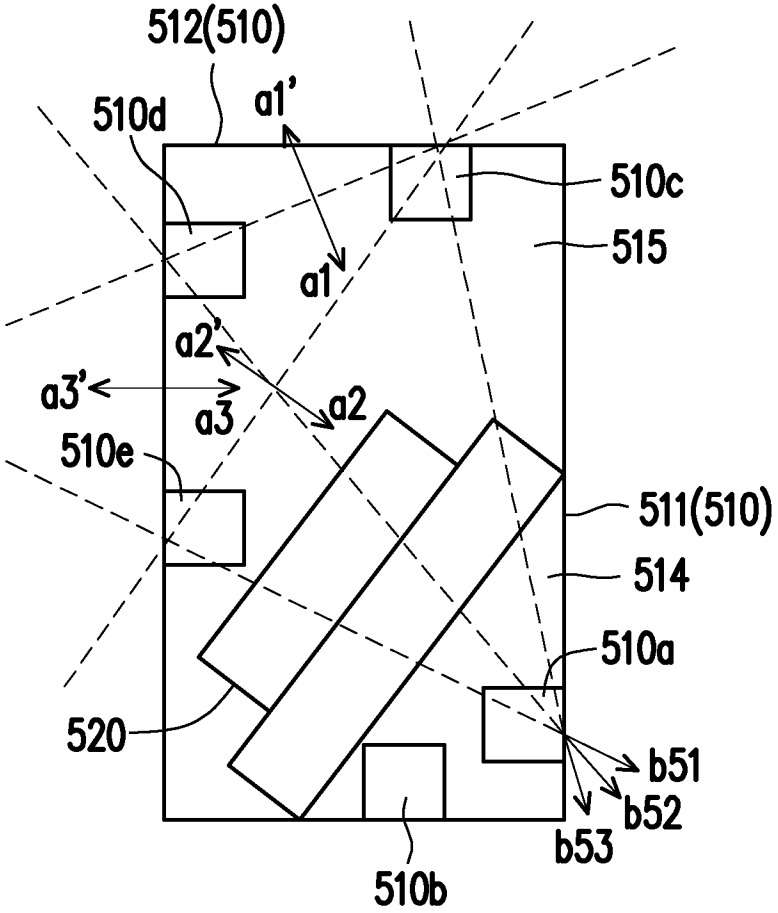
Figure 12C:
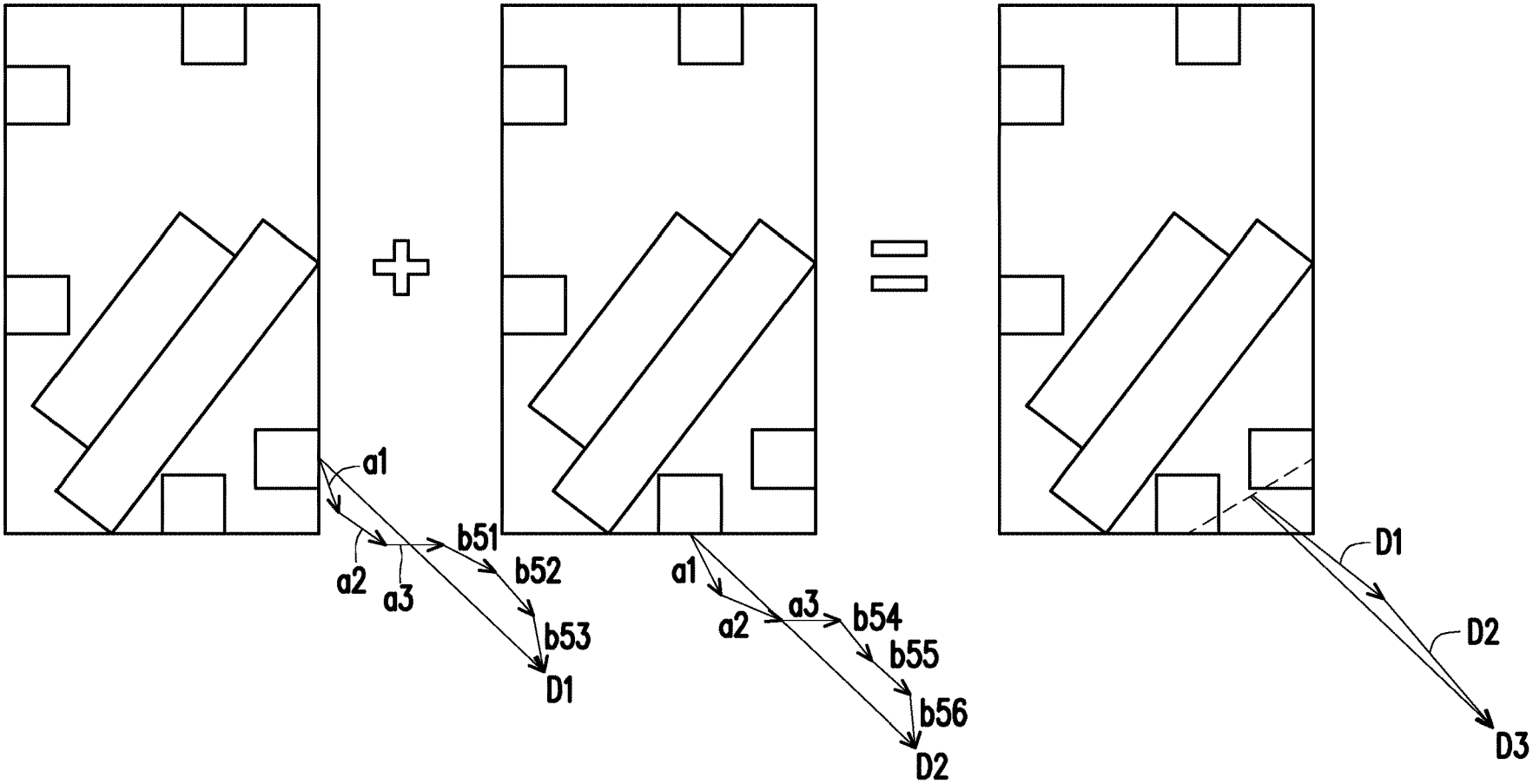

With reference to FIG. 12A to FIG. 12C, a speaker module 500 is approximately identical to the speaker module 100. The difference therebetween is that numbers of the front opening and the rear opening of the speaker module 500 are different from that of the speaker module 100. In this embodiment, an enclosure 510 of the speaker module 500 has two front openings 510*a* and 510*b* and three rear openings 510*c*, 510*d*, and 510*e*. A front cover 511 and a driving unit 520 form a front chamber 514, and a rear cover 512 and the driving unit 520 form a rear chamber 515. The two front openings 510*a* and 510*b* individually communicate with the front chamber 514. The three rear openings 510*c*, 510*d*, and 510*e* individually communicate with the rear chamber 515.

To be specific, connecting lines between the front opening 510*a* and each of the rear openings 510*c*, 510*d*, and 510*e* has vectors b51, b52, and b53 directed to the front opening 510*a*. Connecting lines between the front opening 510*b* and each of the rear openings 510*c*, 510*d*, and 510*e* has vectors b54, b55, and b56 directed to the front opening 510*b*. On the other hand, connecting lines between any two rear openings have normal vectors a1', a2', and a3'. The normal vectors a1', a2', and a3' have reverse vectors a1, a2, and a3 directed to the driving unit 520. A sum of vectors of the vectors b51, b52, and b53 and the reverse vectors a1, a2, and a3 form a first direction D1. A sum of vectors of the vectors b54, b55, and b56 and the reverse vectors a1, a2, and a3 form a second direction D2. On an opening connecting line between the front opening 510*a* and the front opening 510*b*, the first direction D1 and the second direction D2 are added to form a direction D3 of the sum of sound. That is, in the front openings and the rear openings of different numbers, the sum of sound still exhibits directivity.

With reference to FIG. 2 again, on the other hand, the plane formed by the front opening 110*a* has a normal vector N away from the driving unit 120. The normal vector N is perpendicular to the plane formed by the front opening 110*a*. The driving unit 120 has an axis A perpendicular to the front surface 121. The axis A and the normal vector N form a geometric plane. On the geometric plane, an angle between the axis A and the normal vector N is less than 90 degrees. That is, the plane formed by the front opening 110*a* and the axis A are not perpendicular to each other, and the front opening 110*a* and the front surface 121 are not parallel to each other.

Figure 3A:
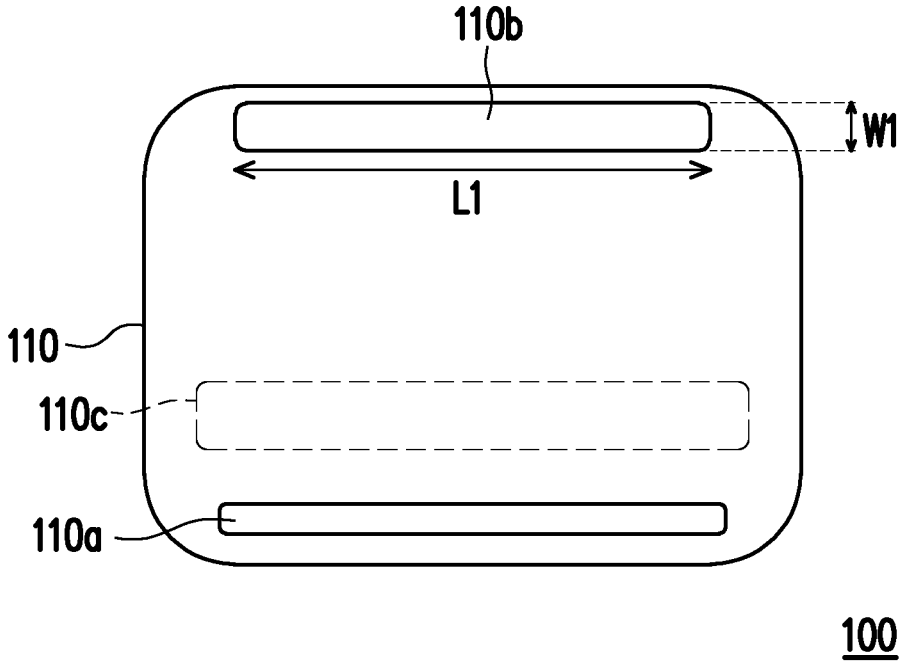
FIG. 3A is a front view of the speaker module of FIG. 1A after being assembled.
Figure 3B:
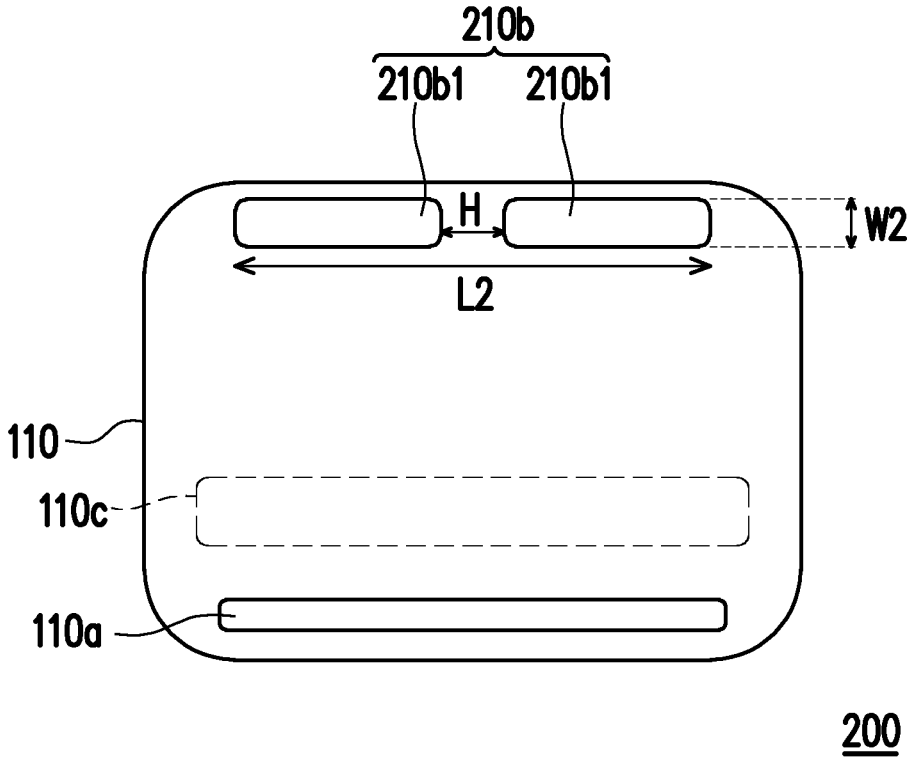
FIG. 3B is a front view of a speaker module according to another embodiment of the disclosure.

With reference to FIG. 3A, in this embodiment, the first rear opening 110*b* is a single opening. Besides, with reference to FIG. 3B, in another embodiment, a speaker module 200 is approximately identical to the speaker module 100 of FIG. 3A. The difference therebetween is that a first rear opening 210*b* of the speaker module 200 includes two secondary openings 210*b*1. In this embodiment, each opening has an effective length. The effective length is that when a gap is not provided between the openings, the effective length is a length of an opening plus twice a width of the opening. When a gap is provided between the openings, but the gap is less than half of the length of the smallest opening on two adjacent sides or less than the width of the opening, the structural gap may be ignored when the effective length is calculated. In the embodiment of FIG. 3B, since a gap H between the two secondary openings 210*b*1 is less than half of a length L2 of the smallest opening on two adjacent sides, the gap H between the two secondary openings 210*b* may be ignored. That is, a length L1 of the first rear opening 110*b* of FIG. 3A is identical to the length L2 of the first rear opening 210*b* of FIG. 3B, and a width W1 of the first rear opening 110*b* is identical to a width W2 of the first rear opening 210*b*. Therefore, the effective length of the first rear opening 110*b* of FIG. 3A and the effective length of the first rear opening 210*b* of FIG. 3B are the same. Besides, similar to the arrangement in which the first rear opening 210*b* of FIG. 3A may be changed to the secondary openings of the first rear opening 210*b* of FIG. 3B and the configuration of the effective lengths, similar arrangement of secondary openings and the configuration of the effective lengths may also be applied to the front opening 110*a* and the second rear opening 110*c* of FIG. 3A.

As described above, in the embodiment of FIG. 3B, the effective lengths of the front opening 110*a*, the first rear opening 110*b*, and the second rear opening 110*c* of the speaker module 100 are approximately identical. In detail, the direction D of the sum of sound of the speaker module 100 is related to the sizes and shapes of the openings. When the sizes and shapes of the front opening 110*a*, the first rear opening 110*b*, and the second rear opening 113*a* are different, the direction D of the sum of sound of the speaker module 100 may be accordingly deduced based on the opening with the smallest effective length.

Figure 4A:
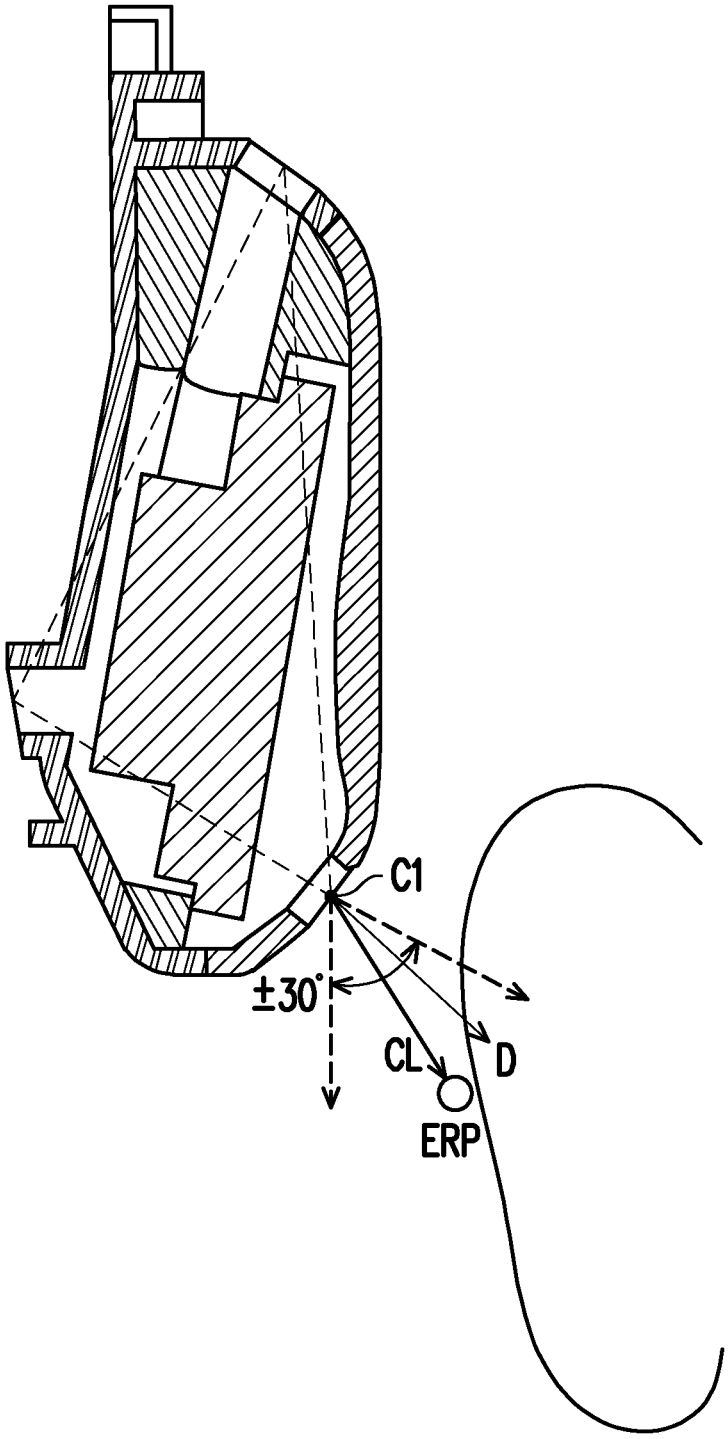
FIG. 4A is a schematic diagram of a direction of a sum of sound and an angle range of a listening angle of the speaker module of FIG. 2.
Figure 4B:
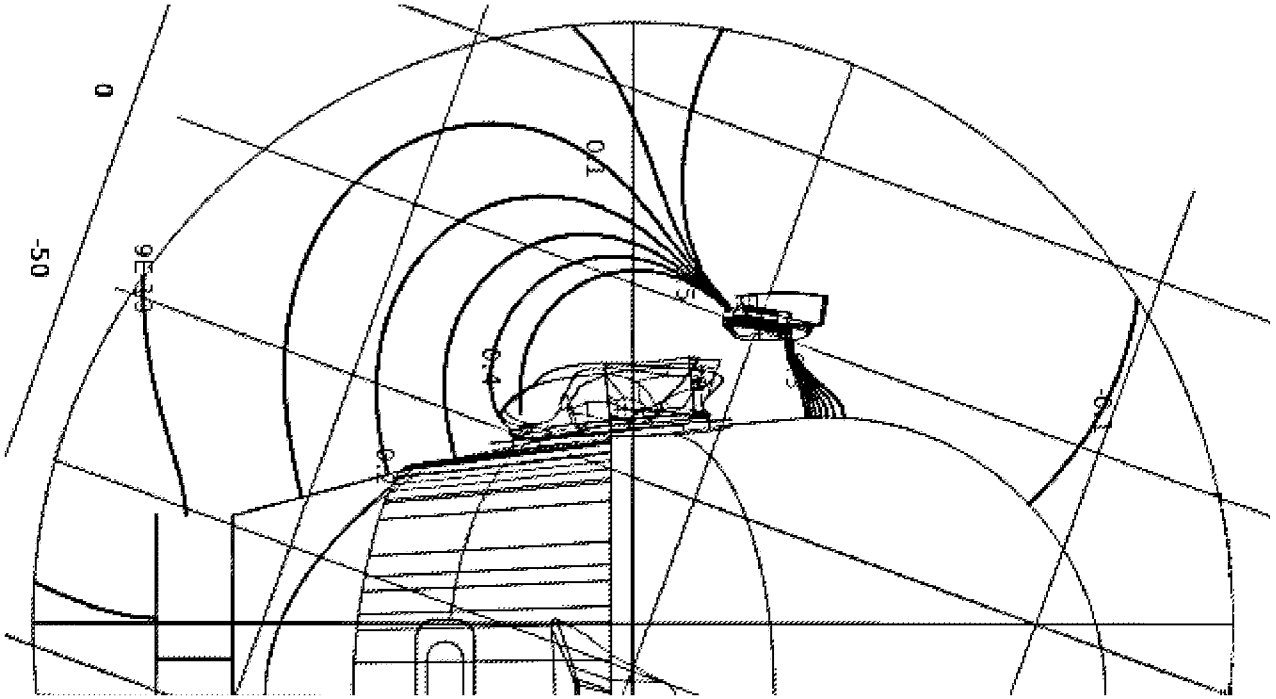
FIG. 4B is a schematic diagram of a sound pressure field generated by the speaker module of FIG. 4A.

With reference to FIG. 4A and FIG. 4B, a connecting line CL is provided between the front opening 110*a* (e.g., the first centroid C1 of the front opening 110*a*) and a human ear reference point (ERP). The direction D of the sum of sound outputted by the speaker module 100 is within plus or minus 30 degrees of the connecting line CL. That is, when a listening range of the speaker module 100 is reduced, it may be difficult for the outside to hear the sound outputted by the speaker module 100 clearly.

Figure 5A:
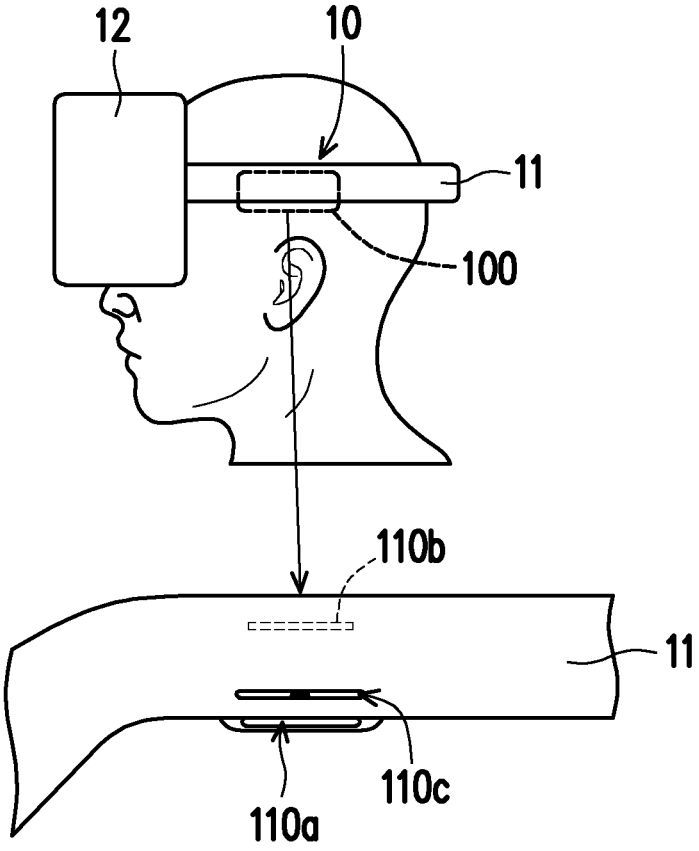
FIG. 5A is a schematic view of a wearable device according to an embodiment of the disclosure.
Figure 5B:
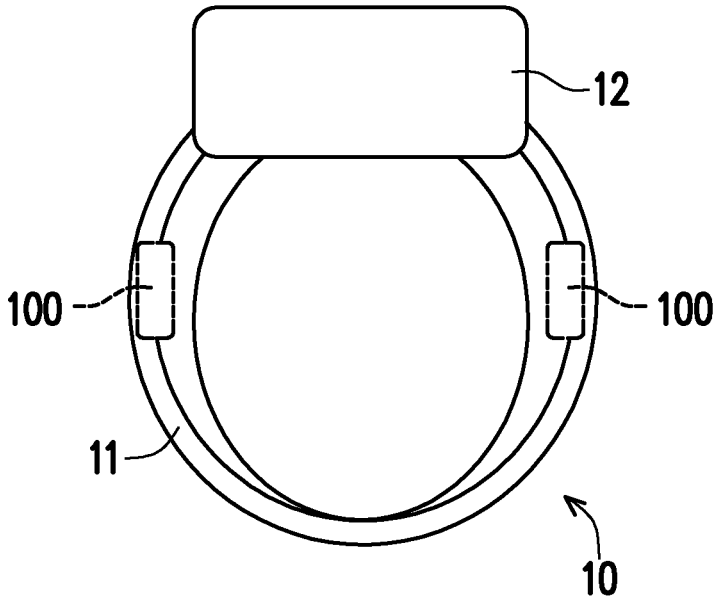
FIG. 5B is a schematic top view of the wearable device of FIG. 5A.
Figure 5C:
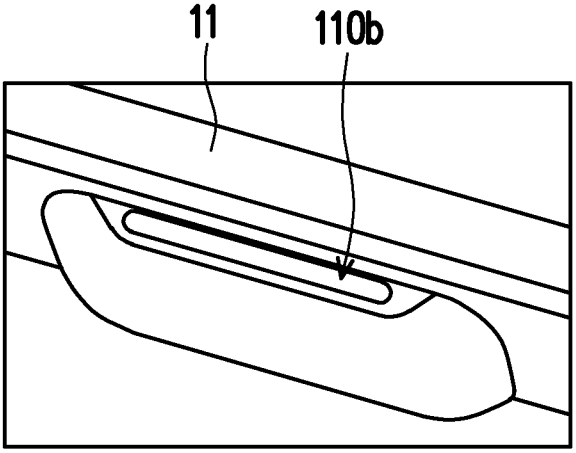
FIG. 5C is a local enlargement view of the wearable device of FIG. 5A.

With reference to FIG. 5A to FIG. 5C, the speaker module 100 is adapted to be disposed on a wearable device 10. The wearable device 10 includes a head mount display (HMD) including a frame 11, a display unit 12, and a pair of speaker modules 100 arranged in the frame 11. The front opening 110*a*, the first rear opening 110*b*, and the second rear opening 110*c* are integrated on the frame 11, that is, a portion of the frame 11 forms the enclosure 110. In this embodiment, the pair of speaker modules 100 may be individually arranged on left and right sides of the frame 11 and are individually close to a pair of ears of a user. The front opening 110*a* and the first rear opening 110*b* of each of the speaker modules 100 face the user's head and are respectively upwards 45 degrees and downwards 45 degrees with respect to the horizontal plane, so that the direction D of the sum of sound may be optimized.

Figure 5D:
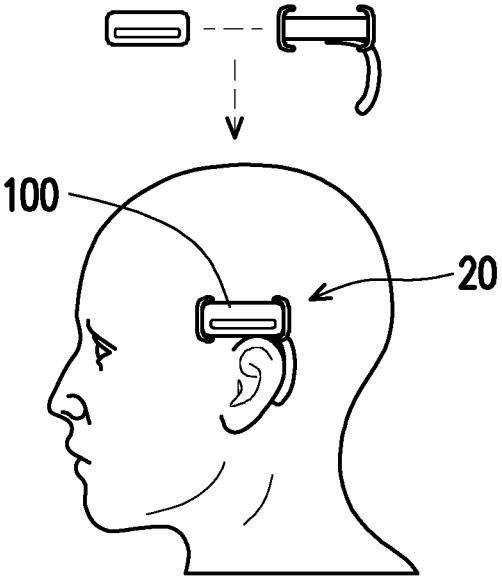
FIG. 5D is a schematic view of a wearable device according to another embodiment of the disclosure.

With reference to FIG. 5D, in another embodiment, a wearable device 20 may also include a frame 21 and one speaker module 100. The speaker module 100 may be detachably disposed on the frame 21. The wearable device 20 is, for example, an ear-hook device. The wearable device 20 is, for example, an ear-hook device.

Figure 5E:
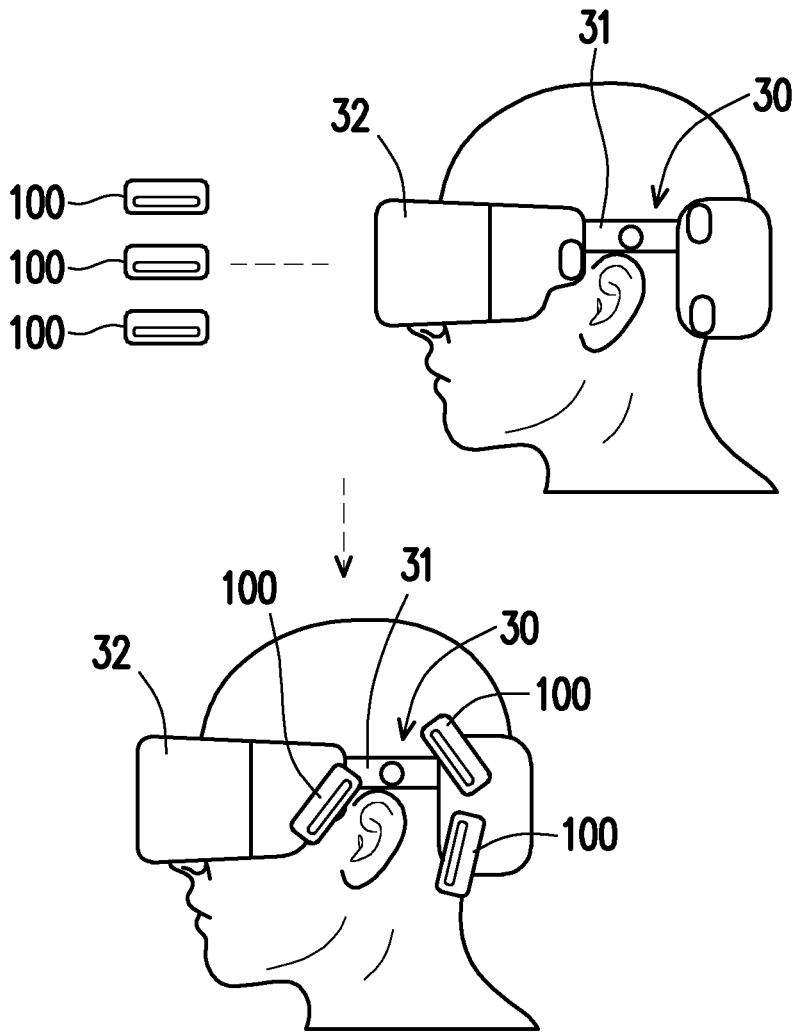
FIG. 5E is a schematic view of a wearable device according to another embodiment of the disclosure.

With reference to FIG. 5E, in another embodiment, a wearable device 30 may include more than three speaker modules 100. These speaker modules 100 are assembled on the wearable device 30 with surround speaker positioning, and the angles of the speaker modules 100 may also be adjusted to improve an effect of surround sound fields. In other embodiments that are not shown, according to the configured frame type, the wearable device may also be a speaker surround listening device, a clip-on device, a neck-mounted device, a shoulder-mounted device, a face-mounted device, etc. The number of the speaker modules may be one or more than one, but it is not limited thereto.

Figure 6A:
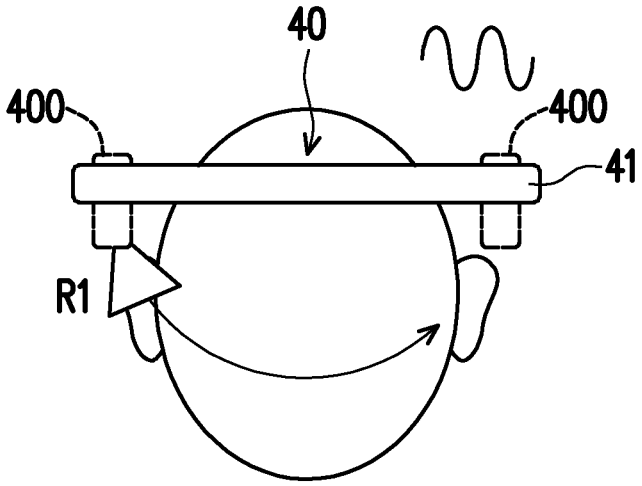
FIG. 6A is a schematic diagram of sound output made by a wearable device having a related speaker module.

With reference to FIG. 6A, generally, a wearable device 40 has two speaker modules 400 arranged on left and right sides of a frame 41 of the wearable device 40. Since each of the related speaker modules 400 has only a single opening, when the speaker module 400 on the left side outputs sound, a forward sound wave R1 is generated and diffused around and is then transmitted to the user's right ear, and interference thereby occurs.

Figure 6B:
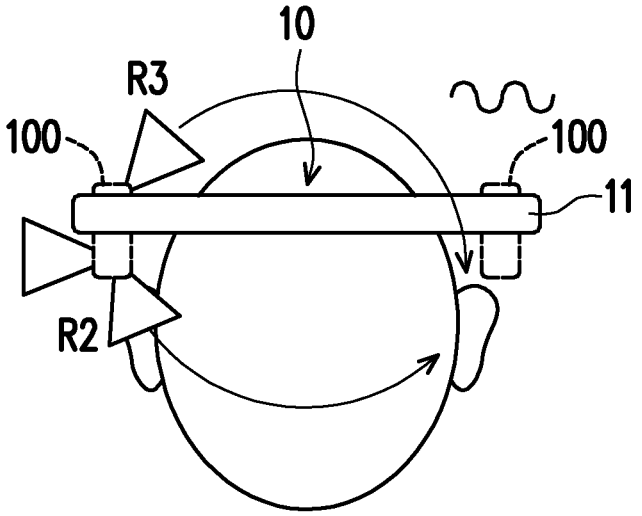
FIG. 6B is a schematic diagram of sound output made by the wearable device of FIG. 5A.

However, with reference to FIG. 6B, each of the speaker modules 100 of FIG. 5A has the front opening 110*a*, the first rear opening 110*b*, and the second rear opening 110*c*. The front opening 110*a* and the first rear opening 110*b* are arranged inside the wearable device 10 and face the direction of the user's head at a specific angle, such that the sound outputted by the left speaker module 100 has a forward sound wave R2 and a reverse sound wave R3 exhibiting an opposite phase to the forward sound wave R2. The forward sound wave R2 is outputted from the opening 110*a*. The reverse sound wave R3 is outputted from the first rear opening 110*b*. When the reverse sound wave R3 and the forward sound wave R2 bypass the user's head and are transmitted to the right ear, since a transmission distance is close and the phases of the sound waves remain opposite, the reverse sound wave R3 and the forward sound wave R2 may cancel each other when meeting at the user's right ear. The interference caused by the sound outputted by the left speaker module on the right ear is thereby reduced. Similarly, when the sound waves of the right speaker module 100 are transmitted to the left ear, the sound waves cancel each other as well, and that the interference caused by the sound outputted by the right speaker module 100 on the left ear is thereby reduced.

Figure 7A:
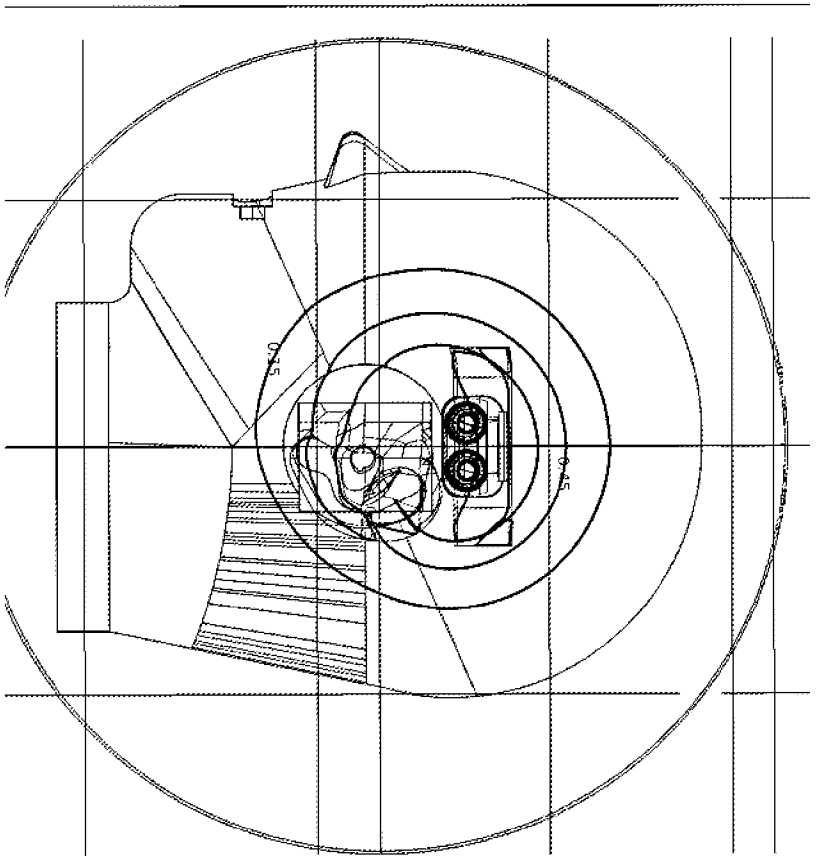
FIG. 7A is distribution of sound fields when the related speaker module outputs sound.

With reference to FIG. 6A again, since the sum of sound outputted by each related speaker module 400 exhibits no directivity, distribution of sound fields of the sound outputted by the related speaker module 400 may diffuse outwards with the speaker module as the center, forming concentric circles with the speaker module 400 as the center, as shown in FIG. 7A. That is, the sound outputted by the related speaker module 400 is not directed to the ear.

Figure 7B:
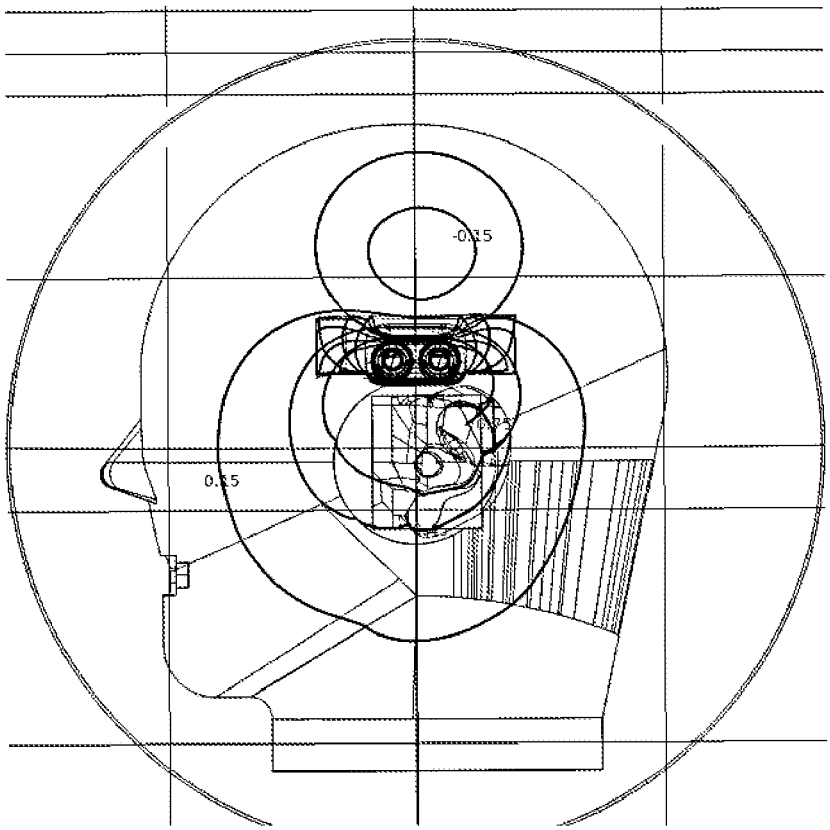
FIG. 7B is distribution of sound fields when the speaker module of FIG. 1A outputs sound.
Figure 7C:
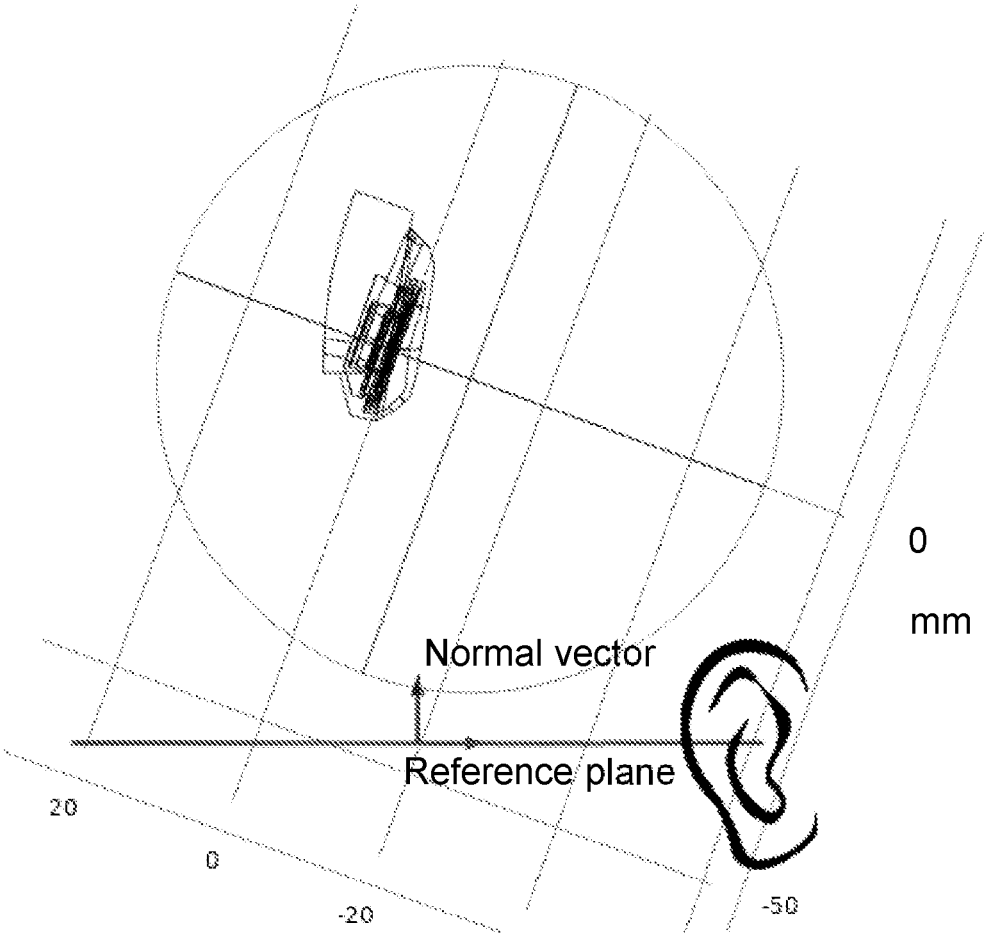
FIG. 7C is a schematic diagram of the speaker module of FIG. 1A at a horizontal plane of an ear height of a user.
Figure 7D:
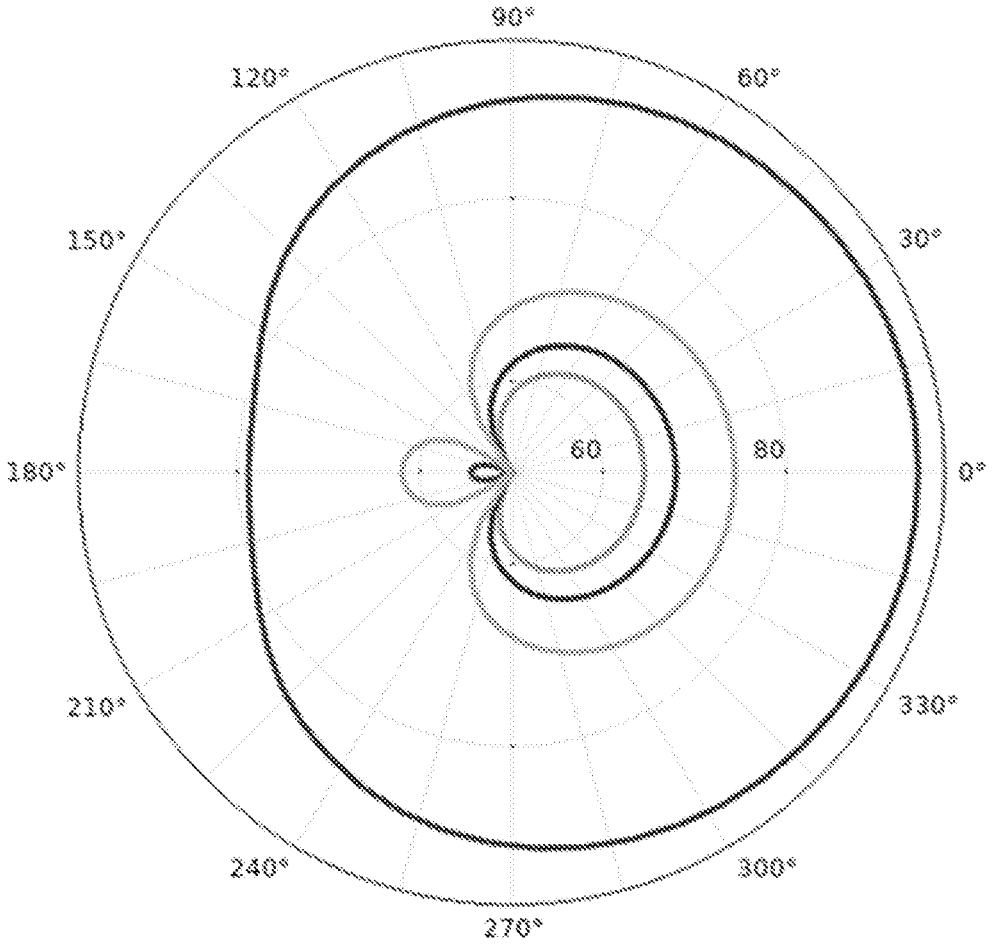
FIG. 7D is a distribution graph of sound fields on a reference plane of FIG. 7C.

With reference to FIG. 6B, since the sum of sound outputted by each speaker module 100 has directivity and is outputted in a direction of the ERP of the user, distribution of sound fields of the sound outputted by the speaker module 100 presents a heart shape and faces the user's ear, as shown in FIG. 7B, FIG. 7C, and FIG. 7D. FIG. 7B is a distribution graph of sound fields of the speaker module 100 of FIG. 1A. FIG. 7C is a schematic diagram of the speaker module 100 at a horizontal height of the user's ear.

Figure 8A:
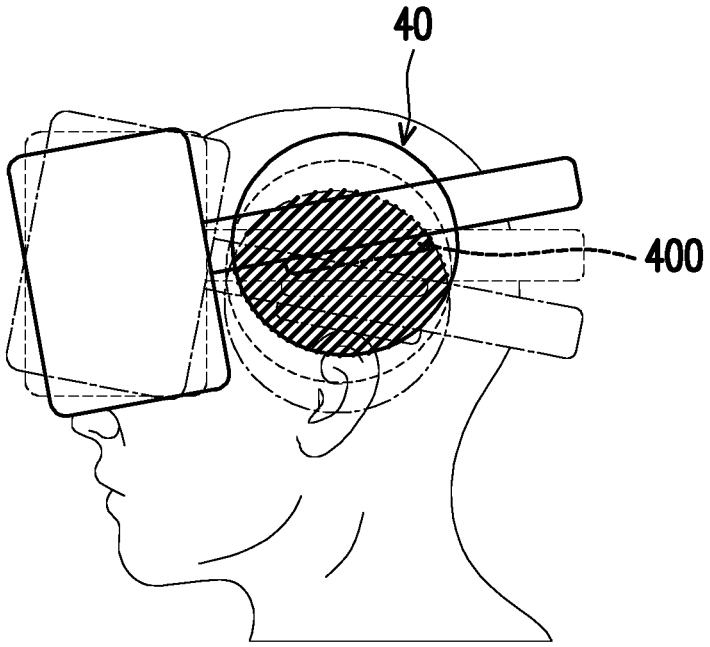
FIG. 8A is a schematic diagram of sound field coverage of the wearable device having the related speaker module.
Figure 8B:
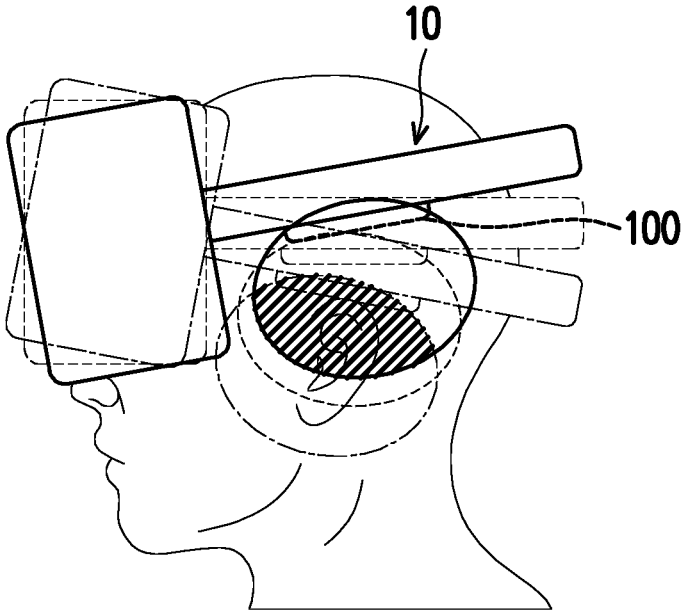
FIG. 8B is a schematic diagram of sound field coverage of the wearable device of FIG. 5A.

With reference to FIG. 8A and FIG. 8B, when the user wears the wearable device 10, wearing positions may be different due to different habits. The oblique areas in FIG. 8A and FIG. 8B are the overlapping areas of the sound fields at different wearing positions. Since the sound outputted by each related speaker module 400 in FIG. 6A does not exhibit directivity, the overlapping areas of the sound fields at different wearing positions may not cover the user's ears, which may cause the quality of the sound to drop. However, since the sums of sound outputted by the speaker modules 100 in FIG. 6B have directivity and are directed to the ears of the user, even if the positions where the wearable device 100 are worn are different, the sound field areas may still be kept to cover the user's ears as much as possible, and the quality of sound is thereby maintained.

Figure 9A:
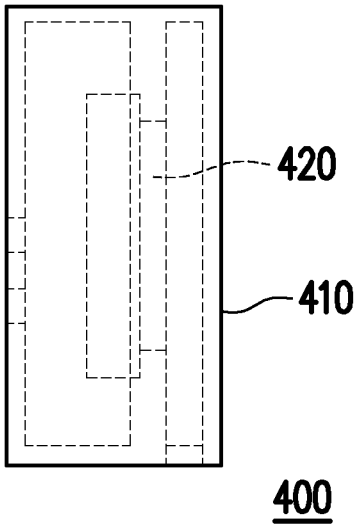
FIG. 9A is a cross-sectional view of the related speaker module.
Figure 9B:
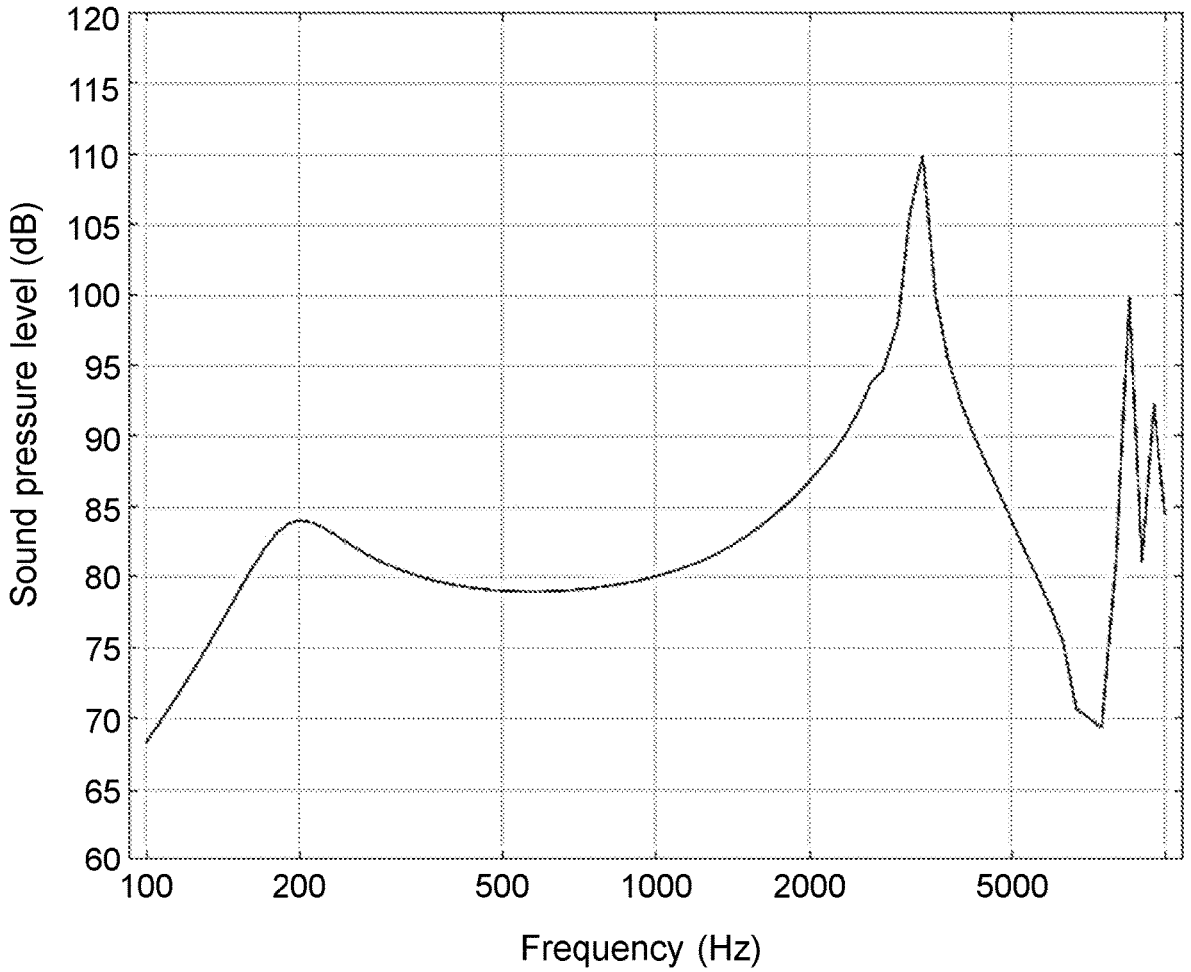
FIG. 9B is a graph of a sound pressure level obtained by the speaker module of FIG. 9A.

With reference to FIG. 9A, since an inner side of an enclosure 410 of the related speaker module 400 is flat and is parallel to a front surface of a driving unit 420, a resonance effect is not provided. Therefore, a peak value of the speaker module 400 at a medium-to-high frequency is approximately 3 kHz, as shown in FIG. 9B.

Figure 10A:
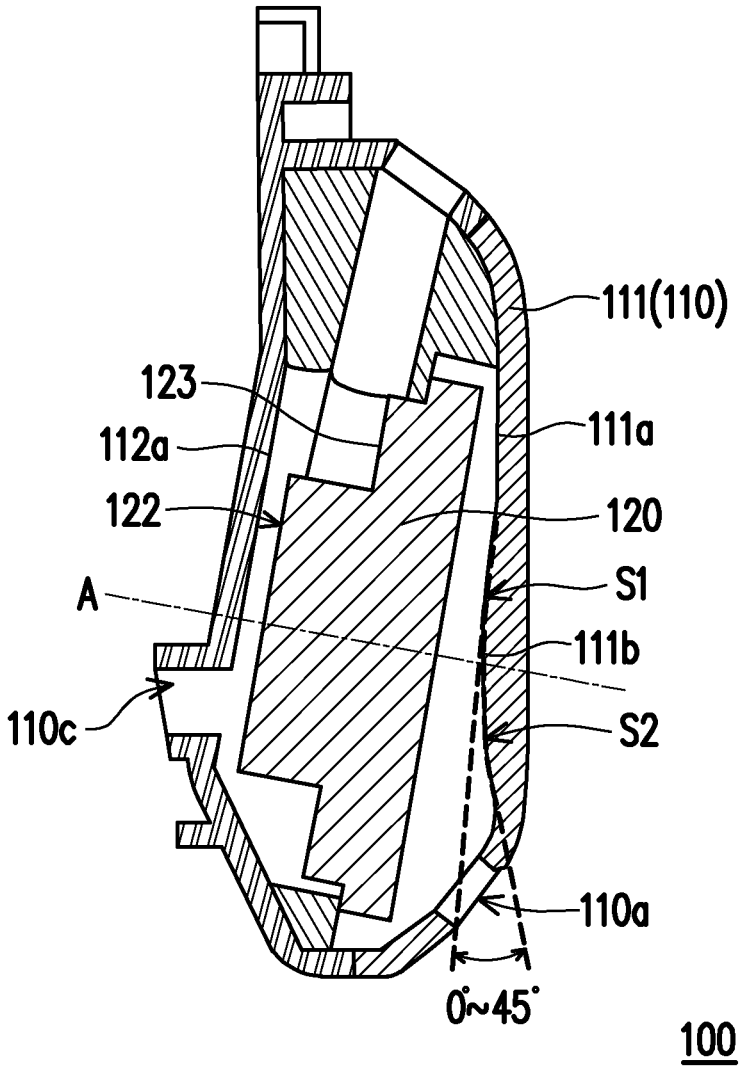
FIG. 10A is a cross-sectional view of the speaker module of FIG. 1A.
Figure 10B:
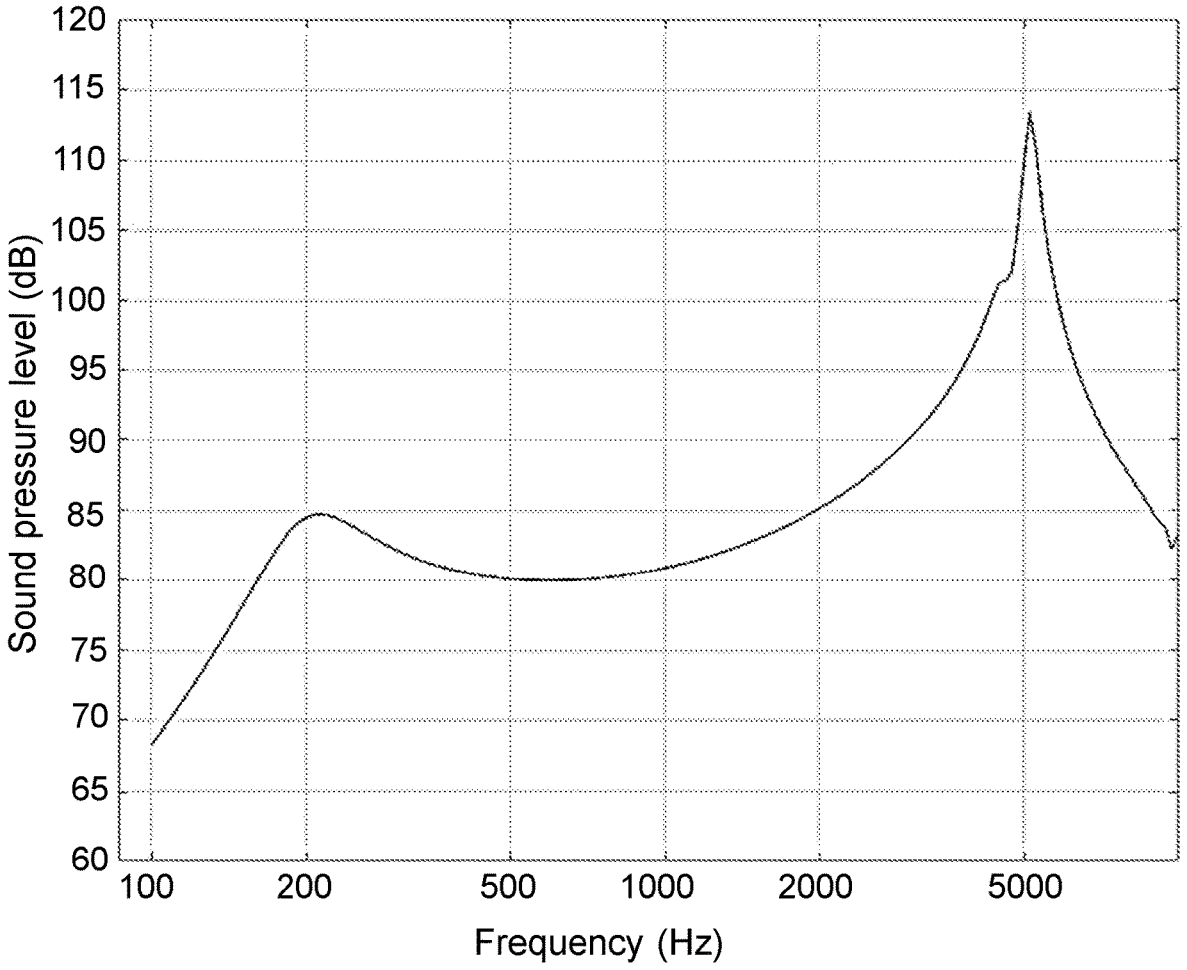
FIG. 10B is a graph of a sound pressure level obtained by the speaker module of FIG. 10A.

With reference to FIG. 10A, an inner surface 111*a* of the front cover 111 of the speaker module 100 has a convex surface 111*b*. The convex surface 111*b* faces the front surface 121 of the driving unit 120, and in this way, a resonance peak value of the front chamber 114 may be increased, and the medium-to-high frequency of the speaker module 100 is increased. To be specific, the convex surface 111*b* has a first inclined surface S1 and a second inclined surface S2. The first inclined surface S1 is parallel to an abutting surface of the driving unit 120, and an angle between the first inclined surface S1 and the second inclined surface S2 is 20°. On the other hand, the second rear opening 110*c* is aligned with the rear surface 122 of the driving unit 120 and a distance between an inner surface 112*a* of the rear cover 112 and the driving unit 120 is within 1 mm, so the peak value of the medium-to-high frequency may be increased to more than 5 kHz. In addition, the angle between the first inclined surface S1 and the second inclined surface S2 20° may be greater than 20° or less than 20°, as long as the angle between the first inclined surface S1 and the second inclined surface S2 is between 0° and 45°, the resonance peak value may be increased, and the medium-to-high frequency may also be increased.

Figure 11A:
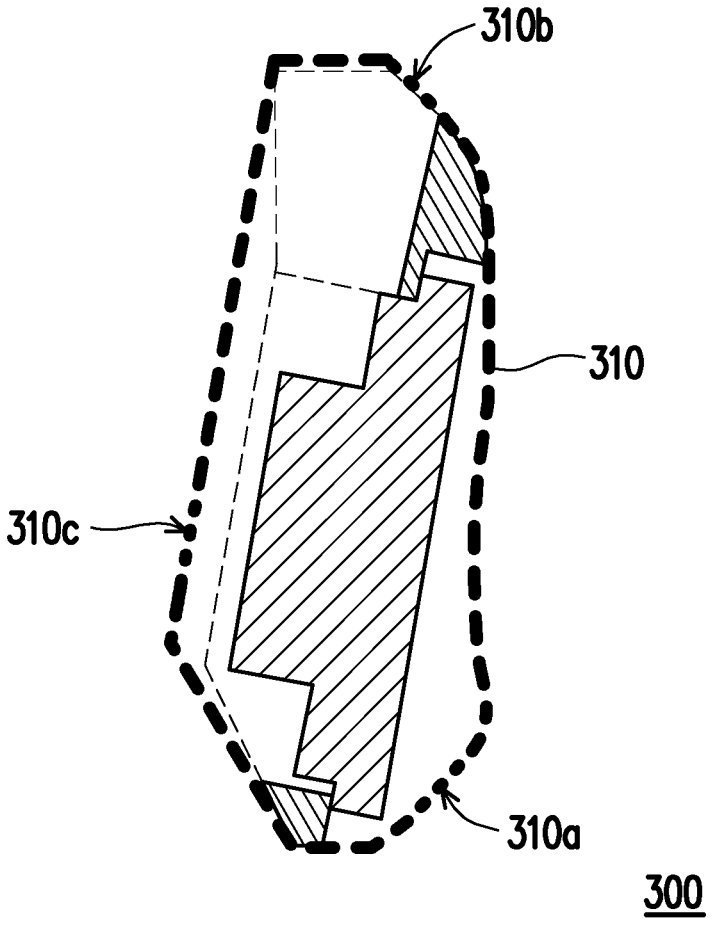
FIG. 11A is a cross-sectional view of a speaker module according to another embodiment of the disclosure.
Figure 11B:
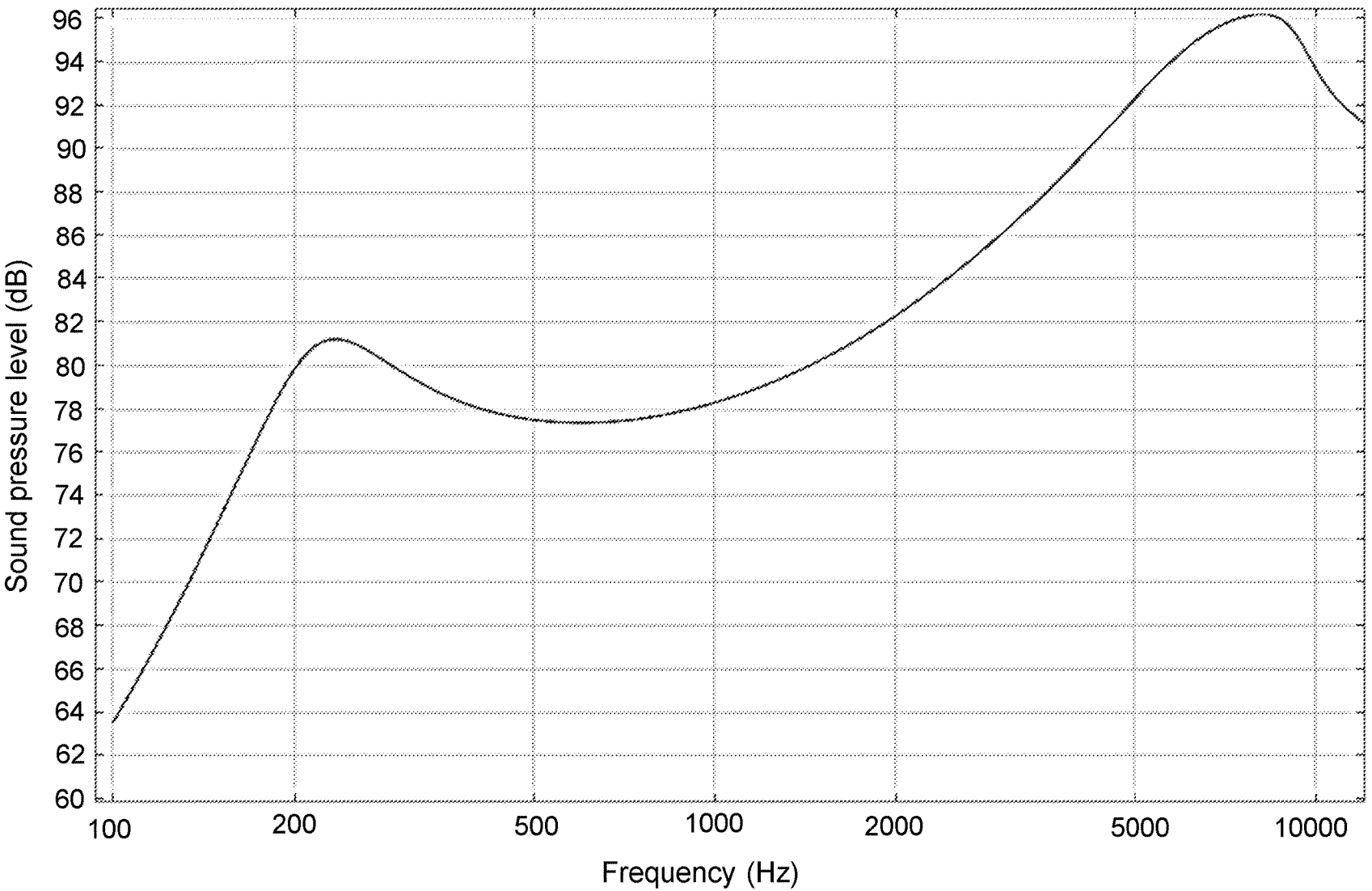
FIG. 11B is a graph of a sound pressure level obtained by the speaker module of FIG. 11A.

With reference to FIG. 11A and FIG. 11B, a speaker module 300 is approximately identical to the speaker module 100. The difference therebetween is that an enclosure 310 of the speaker module 300 is different from the enclosure 110 of the speaker module 100. In this embodiment, the enclosure 310 of the speaker module 300 is a mesh shell, and meshes with higher porosities are used for a front opening 310*a*, a first rear opening 310*b*, and a second rear opening 310*c*. Therefore, the directivity of the sum of sound outputted by the speaker module 300 is kept, and the resonance peak value may be increased to be greater than 8 kHz.

In view of the foregoing, in the disclosure, the sum of sound outputted by the speaker module has directivity, so that the deviation caused by the user's wearing variations and the differences in the structures of the human bodies may be reduced. In addition, the directivity may further isolate voices, making it difficult to hear the voice content outputted by the speaker module from the outside. A private using scenario is therefore created, and the user is allowed to enjoy a realistic listening experience as well as a comfortable using experience.

What is claimed is:

1. A speaker module, adapted to be disposed on a wearable device, the speaker module comprising:

at least one driving unit, configured to produce sound; and an enclosure, containing the at least one driving unit, having a front chamber and a rear chamber, wherein the front chamber and the rear chamber are individually located at two opposite sides of the at least one driving unit, the enclosure has a front opening, a first rear opening, and a second rear opening, the front opening communicates with the front chamber, the first rear opening and the second rear opening individually communicate with the rear chamber, and a sum of sound outputted from the front opening, the first rear opening, and the second rear opening has directivity, wherein the front opening and the first rear opening form a first vector towards the front opening, the front opening and the second rear opening form a second vector towards the front opening, the first rear opening and the second rear opening form a third vector towards the second rear opening, the third vector has a normal vector perpendicular to the third vector, and the first vector, the second vector, and a reverse vector of the normal vector are added to form a direction of the sum.

2. The speaker module according to claim 1, wherein a plane formed by the front opening has a first centroid, a plane formed by the first rear opening has a second centroid, a plane formed by the second rear opening has a third centroid, the first centroid and the second centroid are connected and form a first vector towards the first centroid, the first centroid and the third centroid are connected and form a second vector towards the first centroid, the second centroid and the third centroid are connected and form a third vector towards the third centroid, the third vector has a normal vector perpendicular to the third vector, and the first vector, the second vector, and a reverse vector of the normal vector are added to form a direction of the sum.

3. The speaker module according to claim 2, wherein the first vector, the second vector, and the third vector are unit vectors.

4. The speaker module according to claim 1, wherein the enclosure has a front cover, a rear cover, and a partitioning plate, the partitioning plate is arranged between the front cover and the rear cover, the partitioning plate and the front cover form the front chamber, the partitioning plate and the rear cover form the rear chamber, the partitioning plate has at least one slot hole, and the at least one driving unit is arranged in the at least one slot hole.

5. The speaker module according to claim 4, wherein the front cover further comprises a convex surface, the convex surface faces the at least one driving unit, the convex surface has a first inclined surface and a second inclined surface, the first inclined surface is perpendicular to an axis of the at least one driving unit, and an angle between the first inclined surface and the second inclined surface is 0 degrees to 45 degrees.

6. The speaker module according to claim 5, wherein on a geometric plane formed by the axis and a normal vector of the front opening away from the at least one driving unit, an angle between the axis and the normal vector is less than 90 degrees.

7. A speaker module, adapted to be disposed on a wearable device, the speaker module comprising:

at least one driving unit, configured to produce sound; and an enclosure, containing the at least one driving unit, having a front chamber and a rear chamber, wherein the front chamber and the rear chamber are individually located at two opposite sides of the at least one driving unit, the enclosure has a front opening, a first rear opening, and a second rear opening, the front opening communicates with the front chamber, the first rear opening and the second rear opening individually communicate with the rear chamber, and a sum of sound outputted from the front opening, the first rear opening, and the second rear opening has directivity, wherein the enclosure is a mesh shell, and meshes with porosities of the enclosure at the front opening, the first rear opening, and the second rear opening are greater than the porosity of the enclosure at other portions of the enclosure.

8. A wearable device, comprising:

a frame; and at least one speaker module, the at least one speaker module comprising:

at least one driving unit, configured to produce sound; and an enclosure, containing the at least one driving unit, having a front chamber and a rear chamber, wherein the front chamber and the rear chamber are individually located at two opposite sides of the at least one driving unit, the enclosure has a front opening, a first rear opening, and a second rear opening, the front opening communicates with the front chamber, the first rear opening and the second rear opening individually communicate with the rear chamber, and a sum of sound outputted from the front opening, the first rear opening, and the second rear opening has directivity, wherein the front opening and the first rear opening form a first vector towards the front opening, the front opening and the second rear opening form a second vector towards the front opening, the first rear opening and the second rear opening form a third vector towards the second rear opening, the third vector has a normal vector perpendicular to the third vector, and the first vector, the second vector, and a reverse vector of the normal vector are added to form a direction of the sum.

9. The wearable device according to claim 8, wherein a plane formed by the front opening has a first centroid, a plane formed by the first rear opening has a second centroid, a plane formed by the second rear opening has a third centroid, the first centroid and the second centroid are connected and form a first vector towards the first centroid, the first centroid and the third centroid are connected and form a second vector towards the first centroid, the second centroid and the third centroid are connected and form a third vector towards the third centroid, the third vector has a normal vector perpendicular to the third vector, and the first vector, the second vector, and a reverse vector of the normal vector are added to form a direction of the sum.

10. The wearable device according to claim 9, wherein the first vector, the second vector, and the third vector are unit vectors.

11. The wearable device according to claim 8, wherein an angle between a direction of the sum and a straight line connecting the front opening to an ear reference point is less than 30 degrees.

12. The wearable device according to claim 8, wherein the enclosure has a front cover, a rear cover, and a partitioning plate, the partitioning plate is arranged between the front cover and the rear cover, the partitioning plate and the front cover form the front chamber, the partitioning plate and the rear cover form the rear chamber, the partitioning plate has at least one slot hole, and the at least one driving unit is arranged in the at least one slot hole.

13. The wearable device according to claim 12, wherein the front cover further comprises a convex surface, the convex surface faces the at least one driving unit, the convex surface has a first inclined surface and a second inclined surface, the first inclined surface is perpendicular to an axis of the at least one driving unit, and an angle between the first inclined surface and the second inclined surface is 0 degrees to 45 degrees.

14. The wearable device according to claim 13, wherein an angle between the axis and the front opening is less than 90 degrees.

15. The wearable device according to claim 8, further comprising:

a display unit, arranged on the frame.

16. A wearable device, comprising:

a frame; and at least one speaker module, the at least one speaker module comprising:

at least one driving unit, configured to produce sound; and an enclosure, containing the at least one driving unit, having a front chamber and a rear chamber, wherein the front chamber and the rear chamber are individually located at two opposite sides of the at least one driving unit, the enclosure has a front opening, a first rear opening, and a second rear opening, the front opening communicates with the front chamber, the first rear opening and the second rear opening individually communicate with the rear chamber, and a sum of sound outputted from the front opening, the first rear opening, and the second rear opening has directivity, wherein the enclosure is a mesh shell, and meshes with porosities of the enclosure at the front opening, the first rear opening, and the second rear opening are greater than the porosity of the enclosure at other portions of the enclosure.

17. A wearable device, comprising:

a frame; and at least one speaker module, the at least one speaker module comprising:

at least one driving unit, configured to produce sound; and an enclosure, containing the at least one driving unit, having a front chamber and a rear chamber, wherein the front chamber and the rear chamber are individually located at two opposite sides of the at least one driving unit, the enclosure has a front opening, a first rear opening, and a second rear opening, the front opening communicates with the front chamber, the first rear opening and the second rear opening individually communicate with the rear chamber, and a sum of sound outputted from the front opening, the first rear opening, and the second rear opening has directivity, wherein a number of the at least one speaker module is two, the speaker modules are arranged at left and right sides of the frame, when sound emitted by the speaker module on the left side is transmitted to the right side, the sound is canceled by the speaker module on the right side, and when sound emitted by the speaker module on the right side is transmitted to the left side, the sound is canceled by the speaker module on the left side.

18. A speaker module, adapted to be disposed on a wearable device, the speaker module comprising:

two driving units, configured to produce sound; and an enclosure, containing the two driving units, having a front chamber and a rear chamber, wherein the front chamber and the rear chamber are individually located at two opposite sides of the two driving units, the enclosure has a front opening, a first rear opening, and a second rear opening, the front opening communicates with the front chamber, the first rear opening and the second rear opening individually communicate with the rear chamber, and a sum of sound outputted from the front opening, the first rear opening, and the second rear opening has directivity, wherein the enclosure comprises:

a front cover;

a rear cover; and a partitioning plate, located between the front cover and the rear cover, wherein the partitioning plate and the front cover form the front chamber, the partitioning plate and the rear cover form the rear chamber, the partitioning plate has two slot holes, and the two driving units are separately arranged in the two slot holes, wherein the front opening and the first rear opening form a first vector towards the front opening, the front opening and the second rear opening form a second vector towards the front opening, the first rear opening and the second rear opening form a third vector towards the second rear opening, the third vector has a normal vector perpendicular to the third vector, and the first vector, the second vector, and a reverse vector of the normal vector are added to form a direction of the sum.

* * * * *